United States Patent [19]

Brouwer et al.

[11] Patent Number: 4,466,469

[45] Date of Patent: Aug. 21, 1984

[54] AIR WEFT INSERTION NOZZLE CONTROL SYSTEM

[75] Inventors: Charles W. Brouwer, East Greenwich, R.I.; Karl W. Wueger, Uster, Switzerland

[73] Assignee: Leesona Corporation, Warwick, R.I.

[21] Appl. No.: 273,849

[22] PCT Filed: Jan. 7, 1981

[86] PCT No.: PCT/US81/00017

§ 371 Date: Jan. 7, 1981

§ 102(e) Date: Jan. 7, 1981

[87] PCT Pub. No.: WO82/02411

PCT Pub. Date: Jul. 22, 1982

[51] Int. Cl.[3] ..... B03B 47/30; B65H 17/32

[52] U.S. Cl. ..... 139/435; 226/97

[58] Field of Search ..... 226/97, 7, 95; 139/144, 139/435, 437, 438, 439; 229/97

[56] References Cited

U.S. PATENT DOCUMENTS

| | | | |
|---|---|---|---|
| 3,065,769 | 11/1962 | Svaty | 139/127 |
| 3,424,359 | 1/1969 | Houle | 226/97 |
| 3,645,431 | 2/1972 | Harrison | 226/97 |
| 3,690,530 | 9/1972 | Porter | 226/97 |
| 3,706,407 | 12/1972 | King | 226/97 |
| 3,782,422 | 1/1974 | Vermeulen | 139/127 P |
| 3,813,900 | 6/1974 | Cook | 226/97 |
| 4,087,213 | 5/1978 | Hadama | 417/454 X |
| 4,134,435 | 1/1979 | Cornellier | 139/452 |

FOREIGN PATENT DOCUMENTS

| | | | |
|---|---|---|---|
| 2253862 | 7/1973 | France | 139/435 |

*Primary Examiner*—Edward J. McCarthy
*Attorney, Agent, or Firm*—Burnett W. Norton

[57] ABSTRACT

The actuation of a nozzle utilized for propelling the yarn in an air weft insertion weaving system is controlled by means of a single rotary servo valve having an arrangement of ports adapted to be brought during valve rotation into registration alternately with an air pressure source and with the atmosphere for alternately pressurizing and venting a pilot chamber for opening and closing the nozzle. Preferably, the rotary valve includes a rotary spool enclosed within a sleeve of air permeable material to provide an air bearing for the spool. The actuation of the nozzle is determined by the movement of a diaphragm valve toward and away from the opening of a nozzle supply chamber under the control of the pilot chamber pressure, and the diaphragm is deformed into two annularly separated generally U-shaped convolutions opening toward the interior of the air supply chamber of the nozzle so that the movement of the diaphragm during opening and closing follows a "rolling" or progressively flexing action as the convoluting side walls telescope outwardly and inwardly relative to one another. Preferably, two substantially similar convoluted diaphragms are disposed in axially spaced oppositely directed relation, one exposed to the nozzle supply pressure and the other to the pilot chamber pressure. Advantageously, the interior space between such diaphragm is vented to the atmosphere to maintain a pressure-free condition therein and clearances are provided to prevent entrapment of air resisting deflection of either diaphragm.

17 Claims, 21 Drawing Figures

AIR WEFT INSERTION NOZZLE CONTROL SYSTEM

FIELD OF THE INVENTION

This invention relates to the field of air weft insertion weaving methods and apparatus in which a weft yarn is delivered from a supply to the throat of a weft insertion nozzle which is periodically pressurized to expel therefrom pressurized air or other gaseous propelling medium (the term air being employed here as a general designation for all such media for simplicity's sake) and propel a length of the weft yarn through the nozzle and across the shed of the loom under the driving force of the thus-emitted pressurized air stream, and is concerned more particularly with an improved control system for regulating the actuation of the firing of such nozzle.

BACKGROUND OF THE INVENTION

In application Ser. No. 64,180 of Brouwer et al, filed Aug. 6, 1979, commonly assigned herewith, there is disclosed and claimed a loom and weaving method embodying an air weft insertion system of the type generally defined above in which a pulse of pressurized air of abbreviated duration relative to the duration of the overall weaving cycle of the loom is delivered via a valve from a constantly pressurized air supply chamber to the throat of the weft insertion nozzle directed toward the shed of the loom, which throat is preferably contoured so as to expel such air from its exit opening at a supersonic velocity, the leading end of the weft yarn to be inserted from a weft supply preferably by means of a delivery unit, being disposed within the throat of this nozzle for contact with the air stream passing therethrough and projection thereby into and across the shed of the loom to the opposite side thereof.

This system imposes special and demanding requirements upon the control of the actuation, i.e. opening and closing, of the nozzle valve in order to achieve the air pulse characteristics emitted by the nozzle, including brief duration as well as velocity, needed to impart substantial thrust to the yarn, and in a companion application Ser. No. 64,395 of Brouwer et al, also filed Aug. 6, 1979 and commonly assigned herewith, there is disclosed and claimed a preferred control system for effecting the opening and closing of the nozzle in a manner achieving the required pulse characteristics.

The preferred control system of application Ser. No. 64,395 utilizes a flexible diaphragm as the valve for alternately closing the exit opening of the pressurized air supply chamber and then opening to place the chamber exit opening into communication with the throat passageway of the nozzle wherein the leading weft yarn end is already situated. Advantageously, the air supply chamber is developed as an annular envelope around the nozzle throat passageway so that the exit opening of the chamber is annular and is coterminous and coaxial with an annular inlet opening of the nozzle passageway so that both such openings can be isolated by means of a common diaphragm valve and placed in communication or joined together when the diaphragm opens.

Movement of the diaphragm valve to open and close the supply opening is determined by the application to and release of a control pressure to and from the face of thee diaphragm opposite that face closing the supply chamber opening and preferably nozzle throat openings, as well as such pressure being preferably applied to an annular area of the opposite diaphragm face which area is defined by means of a pilot chamber disposed proximate the opposite diaphragm face. The pilot chamber is alternately placed in communication with a source of pilot or control pressure and the ambient atmosphere, to cause closing and opening of the diaphragm valve, by means of a spool servo valve arrangement which can take several different forms but in all cases incorporates a coordinated pair of rotating spool valves contoured with operative lands and grooves, one governing the pressurization of the pilot chamber and the other governing the de-pressurization or venting of the pilot chamber so that the closing and opening of the diaphragm valve can be carried out independently from a control standpoint. The initial starting angular positions of the spool valves are adjustable relative to one another, thereby permitting direct adjustment of the length of time correspondng to the difference in the starting spool positions the diaphragm valve is allowed to remain open during each cycle of spool rotation.

While the nozzle actuating control system of application Ser. No. 65,395 has been found to work effectively in practice, there is room for improvement. On the other hand, the diaphragm valve which is made of durable heavy rubberized fabric or the like clamped along both its center region and external margins with an intermediate annular flexible region exhibits an operating life in the order of several millions of cycles; and while this durability is certainly high by ordinary mechanical standards, a loom weaving at the rate of 400 picks per minute passes through more than one million cycles during each 48-hour week of a single shift of operation. Consequently, the diaphragm of the above control unit may require replacement after several weeks or at most a few months of use under normal conditions.

On the other hand, the construction of the rotary valve array, while decidedly advantageous in the light of the prior art nozzle control concepts, is complicated especially as regards the precise contouring of the peripheral surfaces of the respective spool valves to form the arrangement of lands and recesses needed to control the flow of pressurized pilot air in both directions therethrough and to impart balancing pressure forces to offset the main air flow effect and avoid premature wear.

OBJECTS OF THE INVENTION

An important object of the present invention is to provide an improved diaphragm valve for an air control system of the type explained above which has a capacity of substantially prolonged operating life by reason of a diaphragm configuration exhibiting rolling or progressively flexing action during its opening and closing movement.

Another important object of the invention is the control of the pilot or control pressure acting on the nozzle diaphragm valve to determine the opening and closing of the same by means of a single spool servo valve of simplified construction in which the time required to reestablish control pressure to close thee diaphragm valve, and thereby determine the period the latter is open, is variable in response to variation in the magnitude of the pilot pressure delivered by the spool valve without adjustment of the angular spool position.

A further object is a rotary spool servo valve which is designed to provide two different ranges of open periods merely by axially reversing its position in a valve housing.

A still further object of the invention is the provision of an air permeable housing for the rotary spool which is maintained under constant pressurization during operation to support the spool on an air bearing and minimize spool wear.

An additional object is the minimization of open space within a nozzle control system to reduce the inherent capacitance and background "noise" of the system.

GENERAL DESCRIPTION OF THE INVENTION

The improved rotary spool servo control valve of the invention comprises a single generally cylindrical hollow spool body disposed for rotarion with a porous or otherwise air permeable housing preferably formed as a hollow sleeve, which is in turn fixedly enclosed within a solid casing. The spool is coupled to a drive shaft by means of a flexible connection. The spool carries pressurizing and venting recesses in sequence on its periphery separated by lands and preferably a pressurizing recess is located in a symmetrical relation on each side of a common venting recess. The permeable housing is penetrated by a feed port with which the pressurizing and venting spool recesses are alternately brought into communication and at least one, and preferably two, independent supply ports for supplying pressurized air to the spool supply recess or recesses and also pressurizing the permeable housing. The exterior casing includes cooperating delivery passageways for furnishing pressurized air to the housing supply ports and delivering air to and from the nozzle pilot chamber via the housing feed port.

The improved "rolling action" diaphragm valve includes an axially spaced pair of diaphragms each anchored at its central and exterior extremities in inner and outer walls of the nozzle with a flexible annular region therebetween. The flexible annular regions each include a coaxial radially spaced pair of telescoping or re-entrantly curved U-shaped convolutions opening in opposite directions, i.e. toward the pilot chamber on the one hand and toward the nozzle opening on the other hand. The respective convolutions are braced between generally parallel backing surfaces on the nozzle walls and retaining lips project partially into the respective convolutions to maintain their general contour while permitting limited axial telescoping movement thereof. The flat arcuate regions of the respective diaphragms separating the two convolutions formed therein are anchored to the opposite sides of a solid ring, floating in the axial space therebetween, and ideally the clearance space about the ring is vented to the atmosphere to eliminate back pressure against the respective diaphragms. An annular seating bank of wear-resistant material is affixed to the intermediate region of the inner diaphragm to seat around the nozzle opening when the valve is in closed position.

BRIEF DESCRIPTION OF THE DRAWINGS

The above stated objects and advantages and others not specified will be more fully revealed when the following detailed descriptions is read in connnection with the accompanying drawings in which:

FIGS. 4–10 are detailed views showing various operative positions of the spool valve assembly, omitting drive components, in which:

FIG. 4 is a fragmentary longitudinal sectional view showing the spool valve body in position for pressurizing the pilot chamber and closing the nozzle diaphragm valve, FIG. 5 is a side elevational view of the assembly casing showing in dotted lines one arrangement of air passages therein with arrows indicating the path of air flow during pilot chamber pressurization, FIG. 6 is a transverse sectional view taken substantially along line 6—6 of FIG. 4 midway through the nozzle body.

FIG. 7 is a transverse sectional view taken substantially along line 7—7 of FIG. 4 and adjacent one end of the nozzle body, FIG. 8 is a longitudinal section similar to FIG. 4 but showing the spool body in venting position, FIG. 9 is a side elevation of the assembly similar to FIG. 5 with the arrows showing the air flow path during venting, while FIG. 10 is a transverse sectional view similar to FIG. 6 but taken along line 10—10 of FIG. 8 and showing the nozzle body in venting position;

FIGS. 11–14 are transverse sectional views similar to FIGS. 6 and 10 but enlarged to show only the spool body and the surrounding portions of the air permeable housing, in which:

Figure 11:
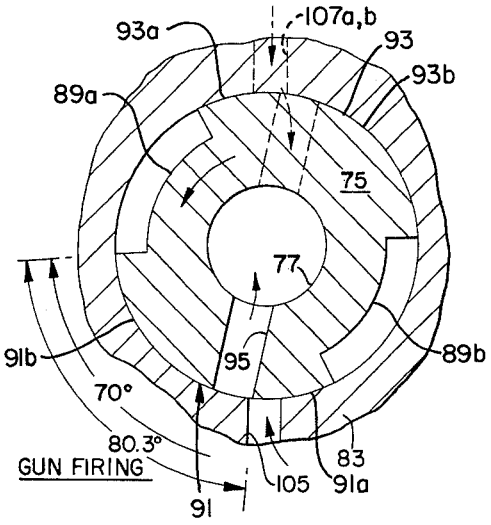
Figure 12:
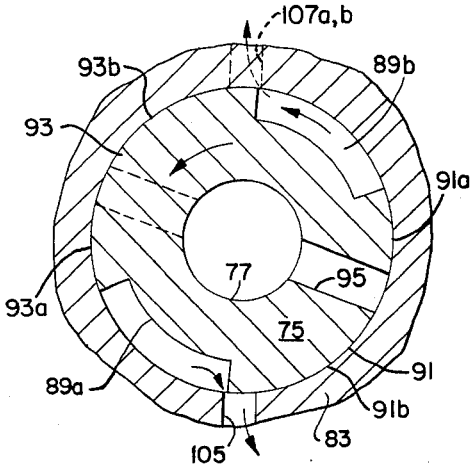
Figure 13:
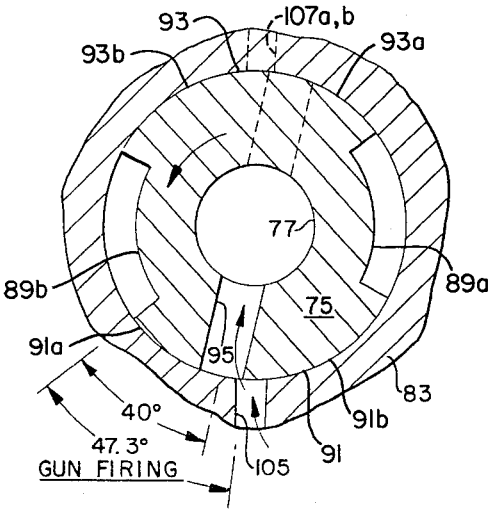
Figure 14:
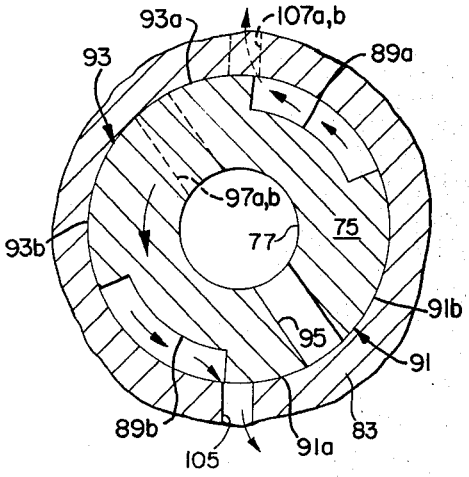
Figure 15:
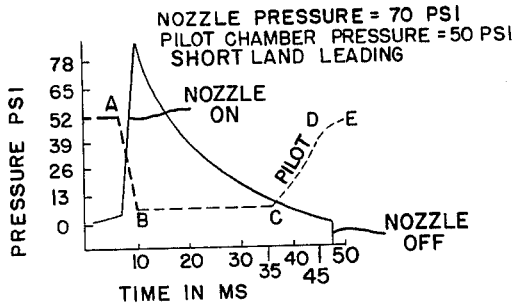
Figure 16:
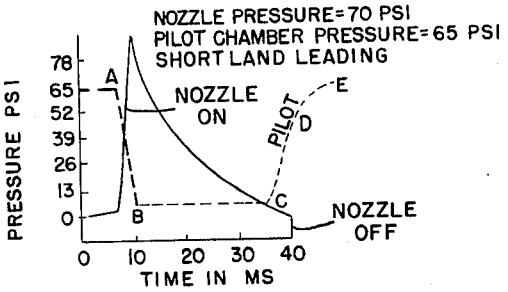
Figure 17:
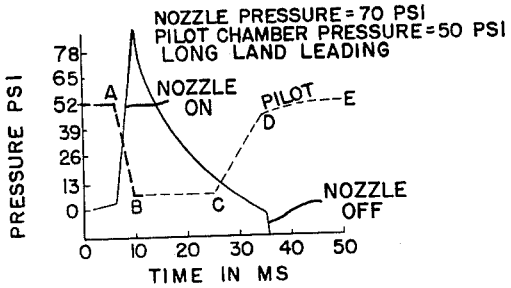
Figure 18:
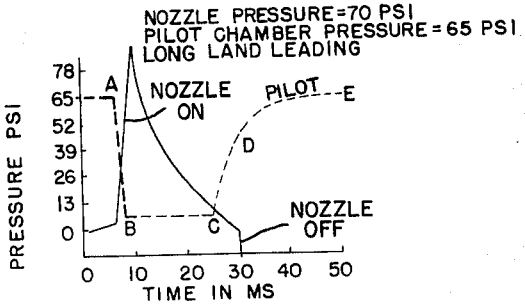
Figure 19:
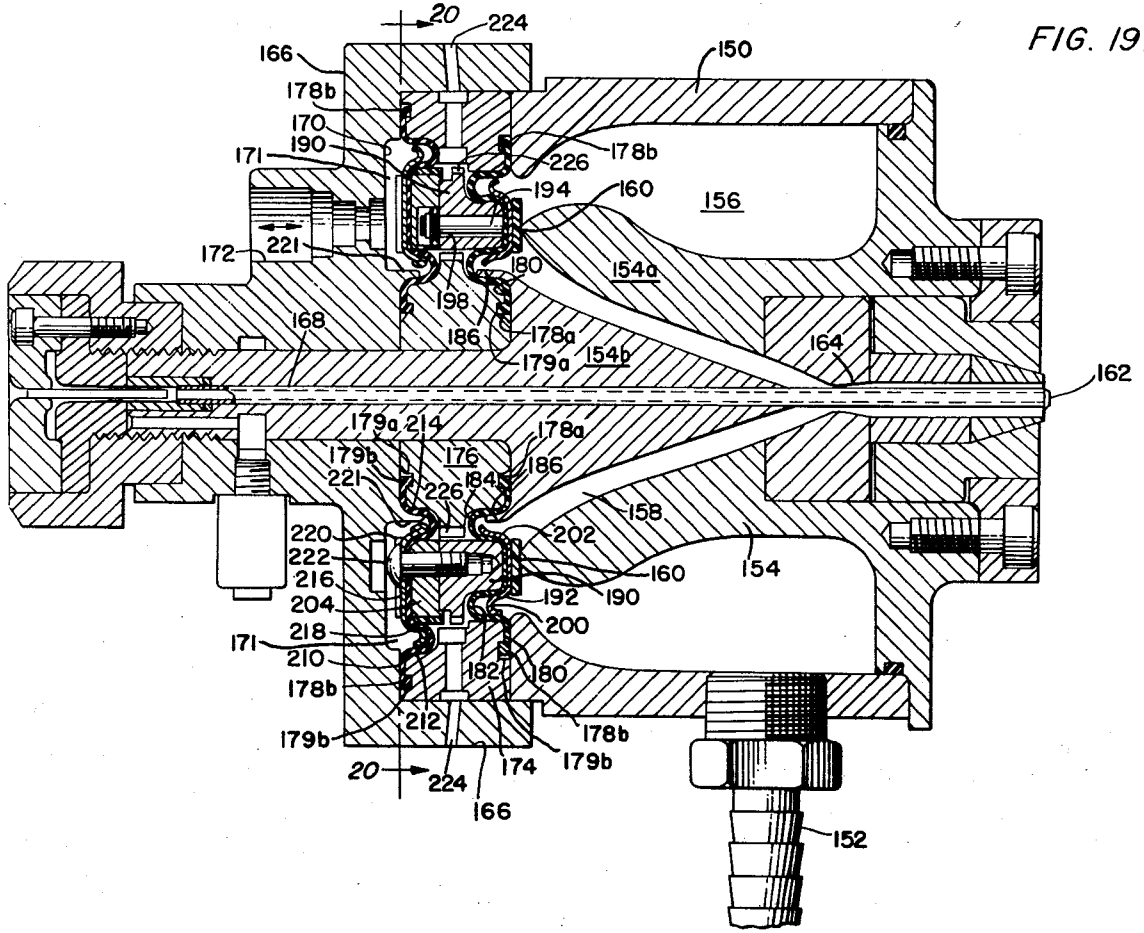
Figure 20:
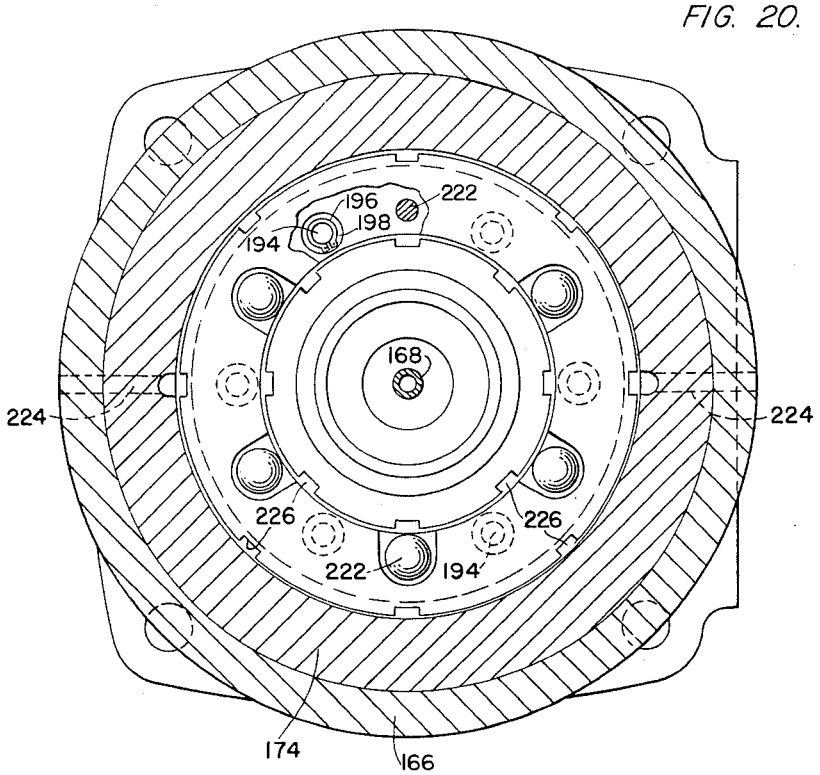
Figure 21:
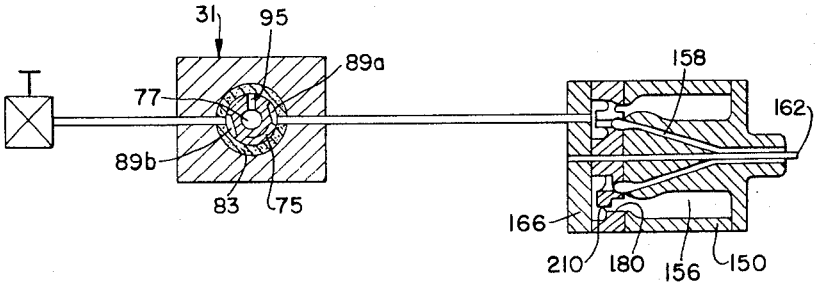

The spool body is shown in FIG. 11 in its position at the beginning of pilot pressure venting and consequential opening of the nozzle diaphragm valve and in FIG. 12 in its position at the beginning of pilot chamber pressurization and nozzle valve closing, but with the spool land of lesser arcuate extent in leading rotational position, while The spool body is shown in pilot chamber venting position in FIG. 13 and in pilot chamber pressurizing position in FIG. 14, both with the arcuately long spool land in leading rotational position;

FIGS. 15–18 are plots of pressure versus time in ms, from the nozzle firing pulse, for nozzle throat pressure (in solid lines) and the pilot chamber pressure (dotted lines) at two levels of pilot pressure with the short spool land in leading rotational position in FIGS. 15 and 16 and in trailing rotational position in FIGS. 17 and 18;

FIG. 19 is an enlarged detailed cross-sectional view through the axis of the weft insertion nozzle, showing a preferred embodiment of the convoluted "rolling action" diaphragm valve;

FIG. 20 is an enlarged end view taken partially in section substantially along line 20—20 of FIG. 19 with the diaphragm and retaining ring omitted to show the interior space between the diaphragms; and FIG. 21 is an overall view greatly simplified of the complete nozzle control system of the present invention.

DETAILED DESCRIPTION OF ILLUSTRATIVE EMBODIMENT

Figure 1:
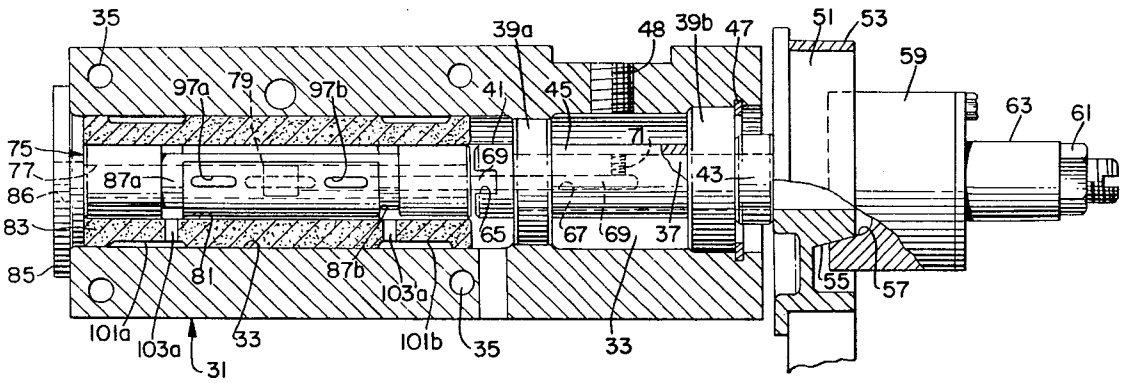
FIG. 1 is a longitudinal sectional view partially in cross-section and partially in elevation taken through the rotary servo valve assembly of the present invention.

Referring now to FIG. 1, the numeral 31 designates a casing for the improved single spool servo valve assembly of the present invention which has a cylindrical interior opening 33 passing axially therethrough but can otherwise be of any convenient exterior configuration, for example, rectangular from all sides. The casing side walls can be penetrated by spaced apertures 35 for the reception of mounting bolts for attachment to a fixed support (not shown). Fitted in the interior opening 33 adjacent one end, i.e. to the right in FIG. 1, is a spaced pair of roller or other bearings 39*a*, 39*b* and an elongated drive shaft 37 is press fitted into the inner races of these bearings for rotation therein. The inner end of shaft 37 has an enlarged head 41 to provide a shoulder retaining the inner bearing 39*a*, while the outer bearing 39*b* is retained on shaft 37 by means of a lock nut 43 anchored thereon. The bearings are held apart by a sleeve 45 and the outer race of the outer bearing is retained against axial movement relative to the casing with a retaining ring 47. A threaded aperture 48 is preferably drilled into the top wall of housing 31 to facilitate attachment of the housing in operative position to a suitable fixture (not shown) by means of a bolt or other fastening means.

Drive shaft 37 extends outside the right end of casing 31 beyond lock nut 43 and rotatably supports a driving pulley 51 encircled by a driving belt 53 driven from a source not shown. Pulley 51 is gripped for bodily rotation with shaft 37 by a friction coupling which can be released to permit initial adjustment of the relative rotational positions of the pulley and shaft. For this purpose, the pulley has a frustoconically shaped hub 55 which is adapted for mating frictional engagement with a conically shaped socket 57 in the adjacent end of a cylindrical collar 59. Collar 59 can be forced into locking frictional engagement with the pulley hub or released therefrom by means of a nut 61 in threadwise engagement with the far end of shaft 37, the movement of the nut being transmitted to collar 59 by means of a spacer sleeve 63 while the inside of pulley hub 55 abuts the lock nut 43. Preferably, the enlarged end 41 of shaft 37 is notched as at 65 so that the shaft bearings, friction coupling, etc., can be easily sub-assembled as a unit and then inserted within the end section of the interior opening 33 of casing 31.

A portion of shaft 37 adjacent head 41 is formed with an axially extending central aperture to receive one end of an elongated flexible driving rod 69 held against movement either axially or rotationally relative to shaft 37 by a set screw 71. Driving rod 69 projects exteriorly of shaft head 41 and its exterior end is adapted to make a flexible driving connection with a rotary spool body generally designated 75, the transverse cross-section of that end being preferably square or other polygonal shape to serve that purpose.

Figure 3:
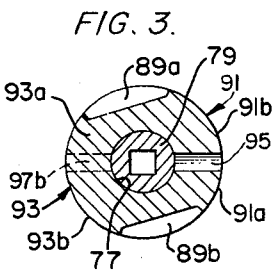
FIG. 3 is a transverse cross-sectional view of the spool body taken generally along line 3—3 of FIG. 2.
Figure 4:
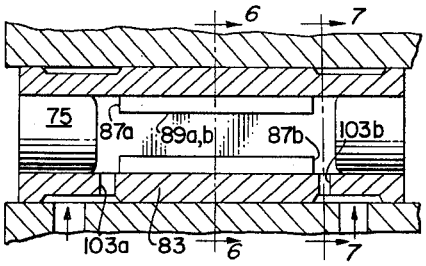
Figure 5:
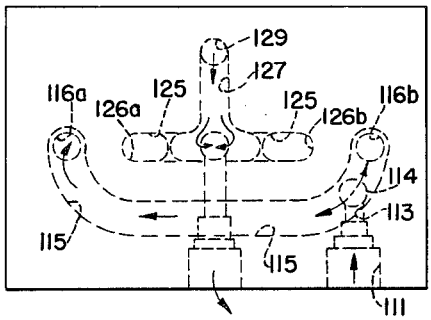

Spool body 75 is of generally cylindrical shape with a hollow interior bore 77 and the projecting end of drive rod 69 extends to about the midpoint of bore 77 and is frictionally embedded at its termination in an aperture of matching shape passing axially through a resilient lock plug 79 (see in dotted lines in FIG. 1 and in section in FIG. 3). Plug 79 has a cylindrical exterior which is press fitted within bore 77 of spool body 75. Hence, as shaft 37 is rotated with pulley 51, that rotation is transmitted by drive rod 69 to spool body 75 to rotate the same; however, drive rod 69 is sufficiently flexible as to permit lateral displacement of the spool body 75 which is thus able to "float" relative to the remainder of the assembly.

Spool body 75 fits within the central aperture 81 of a housing 83, preferably in the form of a cylindrical sleeve, which is advantageously constructed of a porous air permeable yet hard surfaced material such as porous carbon, sintered metal or the like. As will be explained shortly, the pores of air permeable housing 83 are constantly permeated by pressurized air so as to generate an air film "bearing" in the innerspace between the housing interior and the spool body exterior upon which the spool body rides during its rotation. In addition, if the permeable material has a hard surface, as preferred, it can act as a bearing for the spool body in the event air pressurization should fail for some accidental reason. Permeable housing 83 is in turn fixed in air tight engagement within the interior opening 33 of casing 31 and can be positively secured against relative axial movement with an end cap 85 having a central opening 86 communicating with spool bore 77.

Figure 2:
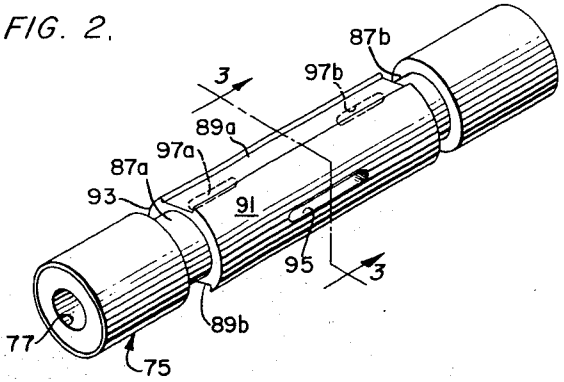
FIG. 2 is a detailed perspective view of the rotary spool body of the assembly of FIG. 1.

As is visible in FIG. 2, spool body 75 is formed with two axially spaced circular air supply grooves 87*a*, 87*b* encircling its periphery and these peripheral grooves are interconnected by at least one, and preferably two, air supply channels or flats 89*a*, 89*b* extending axially along the otherwise solid cylindrical surface of the spool body between the circular grooves 87*a*, *b*. Where two such channels are used, they are diametrically opposed and separate the spool periphery into two segments 91 and 93. In one of these segments, e.g. 91, an axially elongated air feed slot 95, located in lengthwise symmetry with the sleeve body length, passes entirely through the spool body wall into communication with the interior bore 77 thereof, while on the other peripheral segment 93 the spool body wall is penetrated by a spaced pair of axially elongated air balancing slots 97*a*, 97*b* which are equal in length and area to one-half of the length and area of slot 95, being situated in symmetrical position intermediate the ends of slot and the adjacent walls of circular grooves 87*a*, 87*b*. Slots 95 and 97*a*, *b*, could be located symmetrically with the arcuate length of the corresponding segment, i.e. equidistant from the channel 89*a*, 89*b*, but are preferably asymmetrically arranged so as to be closer to one channel than to the other for a reason to be explained.

Figure 6:
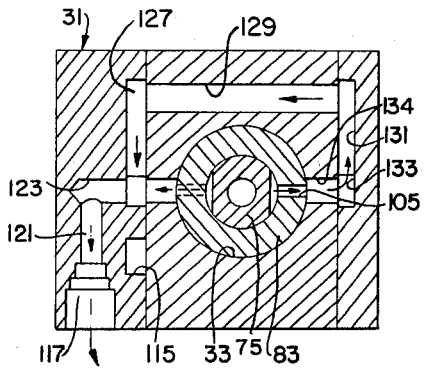
Figure 7:
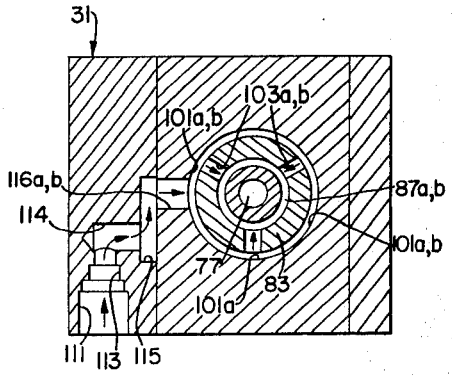

Adjacent its ends, the exterior periphery of air permeable housing 83 is provided with circular manifold recesses 101*a* and 101*b* which are elongated to cover a significant portion, say about 20% each, of the housing length. Recesses 101*a*, *b*, each communicate with a peripherally spaced array, say three, of ports 103*a* and 103*b* passing radially through the thickness of housing 83 at equi-spaced points therearound, the axial location of ports 103*a* and *b*, being such as to coincide and thus communicate with the circular air supply grooves 87*a*, *b*, in spool body 75. Intermediate peripheral recesses 101*a*, *b*, sleeve 85 is penetrated by means of an elongated air feed port 105 (best seen in FIGS. 6 and 10) which is in axial registration with, and generally equal in axial and arcuate dimension to, air feed slot 95 in spool body 75. The opposite side of housing 83 is similarly penetrated by two smaller air balancing ports 107*a* and 107*b* (seen in dotted lines in FIGS. 6 and 10) which likewise register axially with, and are generally equal in all dimensions to, spool body air balancing slots 97*a*, *b*.

The assembly casing 31 is constructed with an arrangement of air supply passageways communicating with the peripheral recesses 101*a*, *b*, and feed passageways 105 and 107*a*, *b*, communicating with the air feed and balancing ports 95 and 97*a*, *b*, and obviously wide variation is possible in the orientation and configuration of these passageways. For purposes of illustration, one suitable arrangement is shown in FIGS. 5–10. In these figures, the casing 31 is shown shaded as a single entity (for sake of better contrast with the housing and spool body) but in practice, as is suggested in these figures, the casing is constructed of several parts to facilitate the machining of the various passageways therein.

In this arrangement, casing 31 has on one side an air supply connection 111 (see especially FIGS. 5 and 7) which is constantly connected by a hose or conduit (not shown) with a source of pressurized air and joins a passageway leg 113, extending vertically upward to intersect with a short lateral leg 114 which opens into a shallow axially directed (see FIG. 5) U-shaped double armed branch 115 connecting at the opposite ends of its via lateral branches 116*a, b,* with the peripheral recesses 101*a, b,* of the permeable housing 83. Consequently, as already stated, housing receses 101*a, b,* are constantly exposed to pressurized air which insures that the entire housing 83 is permeated by air. Also on one side of housing 31, preferably for convenience of connection on the same side as supply port 111, is a nozzle feed connection 117 which is in permanent communication via a hose or conduit (not seen) with the pilot chamber of the nozzle. Nozzle feed connection 117 joins with a vertical leg 121 which intersects with a short lateral leg 123 opening into an axially elongated arm section 125 (best seen in FIGS. 5 and 9). The function of arm 125 is to feed the pressurized air to and from the air balancing slots 97*a, 97b,* in spool body 75 by way of housing balancing ports 107*a, b,* and arm 125 branches laterally as at 126*a, b, in registration with housing ports 107a, b.* In addition, arm 125 has a vertical branch 127 joining at its upper end with a lateral bypass 129 (see FIGS. 5 and 10) that crosses to the opposite side of casing 31 where it connects with a downwardly directed vertical leg 131 that is axially enlarged at its lower end as at 133 and branches in vertical alignment with the opposite branches 126*a, b.* Enlargement 133 serves to establish communication with the nozzle feed slot 95 in the spool body via the corresponding housing port 105 in the permeable sleeve and branches laterally as at 135 to communicate with port 105.

From the preceding description, it will be understood that the supply connection 111 and the associated leg 114 and double armed branch 115 are maintained constantly under pressure from the air supply (not shown) and deliver this air pressure to the housing ports 101*a, b,* and via the port array 103*a, b,* to the circular recesses 89*a, 89b,* of the rotary spool body. On the other hand, the nozzle feed connection 117 connects the nozzle pilot chamber with its associated branches and legs 121, 123, 125, 127, 129, 131, 133 and 135 and thus with the feed port 105 and balancing port 107*a, b,* of the housing nozzle feed. The rotary spool body carries both supply channels 89*a, b,* and venting port 95 and the rotational position of the rotary spool body, therefore, determines the ultimate direction of air flow within these series of passages.

Figure 8:
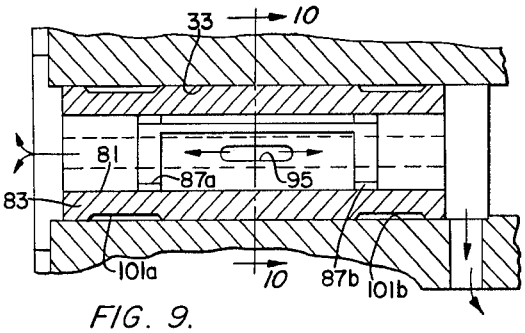
Figure 9:
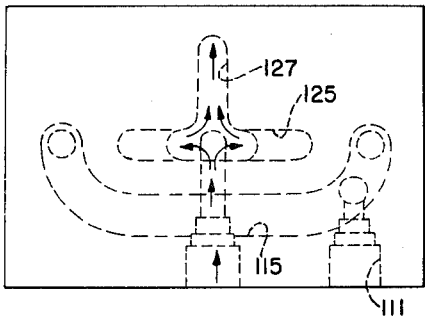
Figure 10:
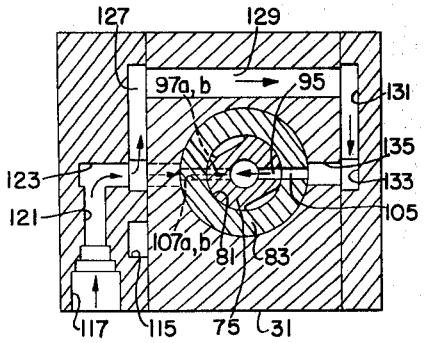

Assuming that the pilot chamber is initially pressurized, forcing the nozzle diaphragm valve into closed position, when spool body 75 rotates to the position of FIG. 11, at which the spool venting slot 95 has just moved into communication with the housing feed port 105, air begins to flow from the nozzle pilot chamber through the connecting conduit into connection 11 and thence via the sequence of passages 114—133 into the spool bore 77 and ultimately to the ambient atmosphere through the open ends of that bore (see also FIGS. 8–10). As the pressure in pilot chamber drops due to the venting of the air therefrom in this manner, the nozzle diaphragm valve will eventually open, permitting the air supply in the nozzle supply chamber to exit into the nozzle throad to "fire" the nozzle. At the same time, air venting from the pilot chamber also passes out via the balancing slots in the spool body which have been simultaneously brought into registration with the balancing ports in housing 83 (as shown in dotted lines in FIGS. 10, 11 and 13) so as to balance the pressure forces acting on the spool body to maintain the same in an equilibrium position within the sleeve opening during the venting phase.

As the spool body 75 continues to rotate, venting slot 95 will move beyond feed port 105 and the latter will become closed off by one of the segments 91,93 of the periphery of the spool body and will remain closed until the trailing limit of that segment has rotated on to bring the leading edge of the following channel 89*a, 89b,* into communication with sleeve port 105 (FIG. 12). Since channels 89*a, b,* are constantly pressurized via circular spool grooves 87*a, b,* pressurized air therein now begins to escape outwardly through feed port 105 and is delivered through the series of passages 114–135 (as diagrammed by the arrows in FIG. 6) and the connecting conduit to the nozzle pilot chamber to begin re-pressurization of that chamber and cause eventual return of the nozzle diaphragm valve to closed position, ending the flow of air from the nozzle throat. Additional air needed to maintain the pressurization of the peripheral grooves 87*a, b,* is supplied from the source through the supply passage sequence 111–114, following the path of the arrows in FIG. 7.

It is within the scope of the present invention to arrange the radial axes of the spool valve body vent port 95 symmetrically with the central radial axis of the spool segment 91, but it will be recalled that preference has already been expressed for an asymmetrical relationship between these axes whereby the feed slot is displaced nearer one edge of the spool peripheral segment than the other. In this way, it becomes possible to employ the same spool to achieve two different ranges of response times for the diaphragm valve and consequently for the duration of the air pulse emitted from the nozzle throat and an understanding of this feature will be facilitated by a comparison of FIGS. 11 and 12 with FIGS. 13 and 14. With the radial axes of spool slots and peripheral segments asymmetrically disposed, each segment is separaged into an arcuately short land 91*a, 93a,* and an arcuately long land 91*b, 93b,* In FIGS. 11 and 12, the spool body 75 is disposed within the housing bore 81 with a short land 91*a, 93a,* in leading position to feed slot 95 relative to the direction of rotation. In this case, after the pilot chamber pressure has been vented while spool vent slot 95 registers with housing feed port 105, feed port 105 becomes closed by the trailing segment 91*b, 93b,* and remains closed until that segment clears the feed port 105. If the trailing segment, therefore, is extended, the closure of port 105 will likewise be extended and repressurization of the pilot chamber is delayed.

Contrariwise, if spool body 75 is inverted or reversed in endwise position within the housing bore 81 to place a long land 91*b, 93b,* in leading position rotationally speaking to vent slot 95, as illustrated in FIGS. 13 and 14, port 105 will remain closed for a shorter period of time due to the lesser arc of the trailing short segment 91*a, 93a,* and re-pressurization of the pilot chammber will start at an earlier time when the spool body rotates to the position of FIG. 14.

Obviously, the difference in arcuate length of the leading segments of the spool valve body for its two positions with the housing 83 will have no influence on the point in the rotation of the spool valve body at which venting, and consequential firing of the gun, will take place, since this point is determined by the location of housing feed slot 105 which is fixed.

When re-pressurization of the nozzle venting chamber begins, with the spool valve body in position shown in either of FIGS. 12 and 14, it will be appreciated that a finite period of time will elapse before the pressure of the air being re-supplied to the nozzle venting chamber has built up to a sufficient level to cause displacement of the nozzle diaphragm valve to closed position, in the manner explained in more detail in the related application Ser. No. 64,395 identified above. The length of this finite re-pressurization period will be influenced to some extent by the capacitance of the delivery system which affects the rate at which air can flow along its path from the pressure supply to the pilot chamber itself. An advantage of the present invention compared to that of the just mentioned prior application, is a reduction in the inherent capacitance of the control valve unit. Another factor determining the duration of the re-pressurization period, however, is the magnitude of the supply pressure being delivered via the spool valve to the pilot chamber, and an important objective of the present invention is the utilization of supply pressure variation to adjust the overall length of the re-pressurization period and thus the ultimate duration of the air pulse emitted from the nozzle throat. As is explained more fully in the prior application Ser. No. 64,395, the magnitude of the pressure required in the pilot chamber needed to achieve closure of the diaphragm valve can be altered by appropriate design of the overall nozzle, particularly as regards the relationship of the effective area on the opposite sides of the diaphragm valve (or valve sub-assembly where plural spaced diaphragms are employed) since it is the effective ratio of the opposited diaphragm regions against which the opposed nozzle supply and pilot chamber pressures bear that establishes the operative ratio between these pressures at which the diaphragm valve opens and/or closes. The effective ratios of the exposes areas of the opposite diaphragm faces can be varied not only by selection of the relative dimensions of the chambers communicating with those opposite faces but, more preferably, by the interposition of a floating ring in an interspace within a dual diaphragm subassembly. The end faces of this ring make contact with adjacent faces of the two diaphragms of the dual diaphragm sub-assembly so that the respective areas of these end faces determines the transmission of opposing pressure forces between the diaphragm pair. By selecting different areas for these end faces, the effective area ratio of the diaphragm valve can be changed so that, as is preferred, a greater nozzle air supply pressure can be controlled with a lesser pilot chamber pressure.

These design considerations thus establish a minimum pilot chamber pressure necessary for a given supply chamber pressure to return the diaphragm valve from open to closed position against the resistance of the pressure of the air passing from the supply chamber through the open valve to the nozzle throat, and this minimum applies in any case. However, the magnitude of the pilot chamber supply pressure above this minimum can be effectively employed to alter within a certain range the re-pressurization period or time of the pilot chamber and hence the duration of the air pulse emitted from the nozzle throat. This concept is illustrated graphically in FIGS. 15–18 which. For these figures, pilot chamber pressure has been measured directly and plotted in broken lines, while a pressure detecting transducer exposed to the pressure in the nozzle throat as shown generally in above-identified application Ser. No. 64,180 is connected to detect changes in the throat pressure and thereby indicate the only points in time of the rise and fall of the throat pressure to thereby define the beginning and end of the pulse and hence its duration. The curves being a few ms. prior to the beginning of venting of the pilot chamber and thus the actuation of the nozzle ($P_o$). The nozzle contains an air supply at 70 psig and the pilot chamber has an effective actuation pressure, i.e. at which the diaphragm valve opens and closes, of 45 psig. The pilot chamber is operated at two levels of pilot chamber supply pressure (i.e. 50 psig and 65 psig) and with the two possible endwise positions of the spool valve, i.e. with the short segment land 91*a, b,* leading in FIGS. 15 and 16 and with the long land 91*b,* 93*b,* leading in FIGS. 17 and 18. In the region of each of these curves between A-B, the diaphragm valve is opening due to venting of the pilot chamber to the atmosphere and the electrical output of the pressure-detecting transducer is rising rapidly because of the avalanching diaphragm behavior described in the above identified application Ser. No. 64,395, to indicate peak throat pressure at time B. As FIGS. 15–18 show, the response of the diaphragm valve and nozzle during time A-B is substantially, if not exactly, constant in all four cases since the pressure vents rapidly from the pilot chamber via venting slot 95 notwithstanding the presence of resilient plug 79 blocking a part of the interior opening of slot 95 and variations in pilot chamber pressure have only slight effect. Between B-C, pilot chamber pressure remains at a minimum, being closed off during this interval by the trailing land of the spool valve body, and this minimum is constant in each pair of curves. The nozzle continues to emit pressurized air during this period and thereafter the transducer output decaying but continuing positive which indicates stable high pressure in the nozzle throat throughout this period. At time C, a pressurzing channel 89*a, b,* has just moved into coincidence with the housing feed port 105 and re-pressurization of the pilot chamber now begins and continues until the full pressure of the pilot chamber supply has been achieved at time E. The slope of the plot of pilot chamber pressure for the interval C-E will vary as a function of the magnitude of the pilot supply pressure, and while the actuation point D is fixed (in all four cases at 45 psig) the location timewise of point D along slope C-E will accordingly change with differing pilot supply pressure. For example, in FIGS. 15 and 16 re-pressurization begins in both cases at about 37 ms after venting but re-pressurization takes about 23 ms at 50 psig pilot supply pressure and about 11 ms for 65 psig pilot supply pressure.

Further insight as to the execution in practice of the concept of regulating pilot chamber re-pressurization time (and nozzle pulse duration) by pilot supply pressure variation will be obtained from the following tabulation showing the pulse widths or durations that have been obtained in test carried out on 50 inch width loom operating at 320 cycles per minute using a spool valve constructed according to the drawings in this application in both possible endwise positions over a pilot supply pressure range of 45-75 psig.

| | Pulse Width ms | | | | | |
|---|---|---|---|---|---|---|
| | Short Land Leading | | | Long Land Leading | | |
| Gun Pressure | 60 | 70 | 80 | 60 | 70 | 80 |
| Pilot Supply Pressure | | | | | | |
| 75 psig | 30 | 35 | 38 | 17 | 20 | 21 |
| 70 | 34 | 36 | 41 | 18 | 23 | 22 |
| 65 | 35 | 38 | 48 | 20 | 24 | 24 |
| 60 | 36 | 40 | 52 | 21 | 25 | 26 |
| 55 | 38 | 43 | 59 | 22 | 29 | 32 |
| 50 | 44 | 46 | 63 | 24 | 25 | 38 |
| 45 | 45 | 53 | 77 | 31 | 42 | 43 |

Obviously, the results of any such test are specific to a given test configuration and cannot be precisely extrapolated to other configurations; they do, however, illustrate clearly the effect on pulse duration of pilot supply pressure variation and are indicative of the degree of that effect under different combinations of significant conditions.

The second major improvement of the present invention concerns the configuration of the dual diaphragm sub-assembly, as preferred, and the details of this aspect, reference is now made to FIGS. 19 and 20. Apart from the diaphragm configuration, the nozzle assembly here is quite similar to that disclosed in above-mentioned application Ser. No. 64,395 and a fuller understanding of the specifics of the nozzle will be found in the explanation appearing in that application. For present purposes only, the general components of the nozzle apart from the diaphragm will be identified. Thus, the nozzle has an exterior casing 150 to which air under pressure is supplied via an inlet port 152. A two-part central core 154*a, b,* extends through the interior of the nozzle, and the space between the core and casing serves as a supply chamber 156 for pressurized air. The two parts 154*a, b,* of the core define therebetween a tapering annular throat passageway 158 beginning at an annular rim 160 of the outer core part 154*a* which rim acts as the valve seat against which the control diaphragm rests in its closed position. When the diaphragm is displaced away from rim 160, throat passageway 158 is placed in communication with supply chamber 156 and the pressurized air accumulated in the chamber is free to pass through throat 158 and out the exit opening 162 of the throat.

Preferably, as is more fully explained in the above mentioned application Ser. No. 64,180, throat passageway 158 is contoured adjacent its exit opening 162, as at 164, with a diverging region to achieve expansion of the air stream passing therethrough with a consequential increase in air stream velocity, preferably up to supersonic speeds. The nozzle body is completed at the end opposite exit opening 162 by a head or cover 166 threaded or otherwise engaged upon the upper end of casing 150, and head 166 is penetrated along its axis by means of a hollow thread insertion tube 168 by means of which the leading end of the weft yarn to be projected by the nozzle is inserted into the nozzle throat. Preferably, insertion tube 168 projects beyond the point of minimum convergence of the throat passage into the divergent region 164 and, more preferably, at least to the exit opening of the nozzle (the yarn itself being omitted from the drawings). The interior face of head 166 is cut away as an annular recess 170 which defines a pilot chamber 171 for the nozzle to which pressurized air is applied and released via the port 172.

Turning now to the details of the diaphragm sub-assembly itself, exterior and interior spacer rings 174, 176 of annular shape are interposed between outer and inner margins of head 166 and the ends of casing 160 and inner core part 154*b* and clamped between the opposed surfaces thereof on both sides of the rings are the exterior and interior margins of two axially separated diaphragms 180, 210. The inner and outer edges of each such diaphragm are thickened to form beads at 178*a, b,* which are adapted to fit within corresponding annular grooves 179*a, b,* machined for that purpose in the faces of spacer rings 174, 176 so as to positively grip the opposite margin of each of the two diaphragms when the nozzle head 166 is secured on casing 150.

The diaphragm adjacent the supply chamber 156 and closing the end opening thereof is designated 180; it is deformed in its intermediate region into two radially spaced apart annular convolutions 182, 184, each generally U-shaped in cross-section and opening towards supply chamber 156.

In its annular region between the spaced pair of convolutions 182, 184, the outer face of diaphragm 180 is clamped between the inner face of a "floating" pressure transmitting ring 190, which has differential end face areas in order to achieve the mechanical operating advantage referred to above in connection with the working differential between the nozzle supply pressure and the diaphragm actuation pressure and an annular retaining ring 192, which is anchored in place on floating ring 190 for movement therewith by a peripherally spaced series of pins 194 brazed or welded at one of their ends to the ring and penetrating through openings provided for that purpose in the diaphragm. Pins 194 extend through ring 190 and are encircled at each of their outer ends by a Truarc split washer 196 seated in peripheral grooves formed on the pin ends, a resilient Belleville spring washer 198 being interposed therebetween to bias the retaining ring and floating ring together. Retaining ring 192 has an unbalanced or lopsided "flying U" cross-sectional contour, the outermost leg 200 of which projects partially into the interior of convolution 182 with a re-entrantly curved termination, while its innermost leg 202 extends along the adjacent wall of convolution 182, both legs, however, ending short of the bottom of the respective convolutions to permit some freedom for relative axial telescoping movement of the convolution walls.

The outer face of floating ring 190, through which the ends of anchoring pins 194 project is covered by an annular hub 204, recessed on its inner face to accommodate those pin ends, and hub 204 defines the actual outer end face area of ring 190 which effectively receives the pilot chamber pressure. Thus, in effect, the floating differential area ring is constituted in two parts, the main part 190 and hub 204, for two reasons, first to facilitate assembly and second to allow the ratio between the end face areas of the ring to be easily altered by interchanging hubs of different annular radius.

Hub 204 is associated with the outer flexible diaphragm 210 closing pilot chamber 170 and similarly to nozzle supply chamber diaphragm 180 diaphragm 210 is deformed into two radially spaced U-shaped convolutions 212 and 214 opening toward the pilot chamber. The region of pilot chamber diaphragm 210 between the convolutions 212 and 214 is in contact with the outer end face of hub 204 and clamped thereagainst by means of an inverted lopsided "flying U" retaining ring 216 similar to ring 192 and having its legs 218, 220 contoured roughly the same as legs 200,202 of ring 192 to project into the convolutions to maintain their contour while still affording some freedom of axial displacement thereto. Inverted retaining ring 216 is affixed in place to hub 204 by peripherally spaced bolts 222 in threadwise engagement at their inner ends with the floating ring body 190.

Although the two diaphragms are made of tough, strong, durable, flexible weaving material, such as a rubberized fabric or a polymer film and the lips of the respective retaining rings 192, 216 function in projecting into the interior of the web convolutions to maintain to some degree the shape of those convolutions, it is nonetheless advisable to furnish backing support to the side walls of the several convolutions and thereby substantially eliminate any possibility for any of these convolutions to spread out or balloon laterally which would tend to reduce their effectiveness during operation and significantly decrease their working life. To this end, the opposed inner and outer sides of the floating ring 190 and the respective spacer rings 174, 196 have their surfaces adjacent the walls of legs of the respective diaphragms shaped to provide shoulders contoured to follow the shape of the diaphragm walls and tightly juxtaposed thereagainst. In this manner, the respective U-shaped diaphragm convolutions, in effect, lie within open ended annular channels and are positively prevented thereby from significant distortion of their U-shaped configuration. In this same connection, it is preferred that the interior wall of each interior convolution 184, 214 each be engaged by a circular tongue 186, 221 projecting axially from the inner core part 154 and the nozzle head 166, respectively. Similar circular tongues could be provided on the outer edges of nozzle casing 150 and head 164 to project into the interior of the adjacent convolutions 182, 212 if desired, but it has been found that approximately the same function can be performed by the re-entrantly curved termination of the outer retaining lips 200, 218 without the necessity for providing an additional set of circular tongues.

Preferably, a separate valve seat plate formed of wear resistant resilient material such as high density polyurethane or the like is adhered to the exposed surface of retaining ring 192 to seat directly upon the nozzle rim 160 and receive the wear imparted by such rim during operation rather than the diaphragm fabric itself.

It will be appreciated that when the pilot chamber 170 is vented to the atmosphere through port 172, the nozzle supply pressure in supply chamber 156 which bears against the nozzle diaphragm 180 will at some point exceed the falling pilot chamber pressure and force the exposed region of diaphragm 180 to move axially away from the nozzle rim 160 and consequently open nozzle passageway 158 to the flow of air from the supply chamber 156 and out through its exit opening 162. As diaphragm 180 undergoes such displacement, convolutions 182, 184 each flex with a rolling or progressively shifting action as the individual convolution walls telescope with respect to one another, to shorten the innermost wall, while lengthening the outermost wall in contrast to the simple vibratory behavior of an ordinary diaphragm. Pilot chamber diaphragm 210 behaves in a similar but inverted fashion, the innermost walls of its two convolutions 212, 214 becoming shorter and the outermost walls extended as they telescope relative to one another following the same rolling or progressively advancing action. When the pilot chamber is re-pressurized to restore the diaphragms to starting position to close the nozzle, the two diaphragms behave in precisely the opposite manner to that just described.

Naturally, the diaphragm convolutions should open in the direction of the higher pressure to which they are exposed since otherwise the applied pressure would tend to force the convolutions in the opposite working direction and greatly increase the severity of wear received by the diaphragms and consequently substantially shorten their life. Since operation, the diaphragm valve of the invention, necessarily has the higher effective pressure applied alternately to its opposite sides, the problem that would otherwise exist is resolved in accordance with the invention by the provision of dual diaphragms, each isolated to receive the higher pressure on only one of its faces and oriented to receive that pressure. For the same reason, the pressure acting on the low pressure side of each of the diaphragms opposite the high pressure side should be minimized and for this purpose the interior space between the two diaphragms 180, 210 not floating ring 190 is preferably vented to the atmosphere by means of one or more vents 224 passing through the outer ring 174 and nozzle head 166. In addition, the clearances between the opposite peripheral surfaces of floating ring 190 and the inner and outer spacing rings 174, 176, which clearances are preferably restricted in order to limit bodily lateral movement of ring 190, are prevented from entrapping air and thereby increasing resistance to the free movement of the diaphragms by cutting axial slots as at **226*a* as needed at peripherally spaced points therearound (see especially FIG. 20**).

What is claimed is:

1. A control system for an intermittently-operating strand delivery system including: a nozzle passageway through which the strand is guided, a supply for pressurized medium, and conduit means connecting between said nozzle passageway and said supply including a pressure-operated on-off flow control valve, which is normally open under the pressure of said medium, said control comprising a source of pressurized control medium; means for adjusting the magnitude of the pressure of said control medium, and servo valve means for alternatively applying and releasing control medium under said adjusted pressure to and from said pressure-operated flow control valve which servo means comprises a rotary spool and a housing in which said spool is rotatably disposed in generally pressure-tight relation, said housing having at a given point in the periphery thereof a delivery port in communication with said flow control valve, and said spool having at points around its periphery separated by a predetermined arc a venting passage adapted to be in communication with the ambient atmosphere and a feed passage adapted to be in communication with said source of control medium at said adjusted pressure, said venting and feed passage being brought in succession into registry with said housing delivery port during rotation of said spool to successively release said control medium pressure from and re-apply the same to said housing port and thence said control valve, the period required for the re-applied control medium to return to the magnitude of said adjusted control medium pressure varying with the latter.

2. The system of claim 1 wherein said spool venting and feed passages are in constant communication respectively with said ambient atmosphere and said control medium source.

3. The system of claim 1 wherein said spool includes two of said feed passages at separate points around its periphery which are spaced from said venting passage by different predetermined arcs whereby the elapsed time between venting and re-applying control medium pressure during spool rotation can be changed by axially inverting the spool within said housing.

4. The system of claim 1 wherein said housing comprises a porous sleeve surrounding said spool with said delivery port passing therethrough and means for premeating said porous sleeve with said control medium to provide a bearing film of said medium around said medium.

5. The system of claim 1 wherein said supply of said pressurized medium comprises a supply chamber in communication with a source of said pressurized medium and opening from said chamber an annular exit opening and a feed conduit generally coaxial and co-terminus at its inlet end with said annular exit opening; and said flow control valve comprises a flexible diaphragm extending in proximity over said annular exit opening and said feed passage inlet end, said diaphragm being movable from and to a first operative position contacting and closing said exit opening and inlet end with one of its faces to and from a second operative flexed position spaced from said opening and inlet end to establish communication between them and allow medium to flow from said chamber through said conduit into said nozzle passageway; and means connecting the delivery port of said flow control valve housing to the opposite face of said diaphragm to thereby apply and release said adjusted control medium pressure to and from said diaphragm to control its movement between said two operative positions.

6. The system of claim 5 wherein said diaphragm has two radially separated generally U-shaped annular convolutions therein, said convolutions having their open ends opening in the direction of said supply chamber with one of said open ends generally coinciding with said annular supply chamber exit opening and exposed to the pressure of the medium therein, the annular region of said diaphragm between said convolutions moving bodily between said two operative positions with the convolution walls progressively telescoping to accommodate said movement, whereby the diaphragm flexes with a generally rolling action to increase its operating life.

7. The system of claim 6 wherein said flow control value comprises a pair of axial spaced diaphragms each including a radially separated pair of said convolutions, the open ends of the convolutions in the diaphragm adjacent said supply chamber opening in the direction of the same and the open ends of the convolutions in the diaphragm remote from said supply chamber being exposed to the adjusted pressure of control medium, and a mechanical connection between the annular regions of said diaphragms between the respective pairs of convolutions thereof.

8. The system of claim 7 including rigid retaining means projecting into the interior of each of said convolutions to maintain its general shape and limit the extent of relative telescoping movement of its walls.

9. The system of claim 8 including means for venting the space axially separating said pair of diaphragms to the atmosphere to minimize resistance to the movement thereof.

10. In a control system for an intermittently-operating strand delivery system which includes a nozzle passageway through which the strand is guided; a supply of pressurized medium for said nozzle to deliver the strand therethrough; and conduit means connecting between said nozzle passageway and said medium supply and including a pressure-operated on-off flow control valve and servo valve means for alternatively applying and releasing control medium to said control valve to operate the same: the improvement wherein said flow control valve comprises a housing defining two concentric annular openings, one connected to said medium supply, and the other connected with said nozzle passageway, separated by a common cylindrical lip, and at least one flexible diaphragm extending over both said concentric openings with its interior and exterior margins projecting therebeyond anchored against movement for preventing communication between said opening when in contact with said lip and permitting such communication when flexed away from said lip, said diaphragm having two radially separated generally U-shaped annular convolutions therein, said convolutions opening generally in the direction of said supply chamber with one of said open ends generally coinciding with said annular opening connected to said medium supply and exposed to the pressure of the medium therein, the region of said diaphragm intermediate said convolutions being adapted for bodily movement into and away from abutment with said separating lip to close off and interconnect said two annular openings while the walls of the respective convolutions undergo a progressive relative telescoping movement toward and away from said openings, whereby the diaphragm flexes with a generally rolling action to increase its operating life.

11. The control system of claim 10 including a second of said diaphragms having said two generally U-shaped annular convolutions therein and mounted in axially spaced coaxial relation to the first of said diaphragms.

12. The system of claim 11 wherein said two spaced diaphragms define an annular space therebetween and including means for venting the interior of said intervening annular space to said atmosphere.

13. The system of claim 11 wherein the generally U-shaped annular convolutions of said two diaphragms have the open ends thereof facing in mutually opposite directions.

14. The system of claim 10 including means for restricting the axial movement of said diaphragm convolutions in either axial direction.

15. The system of claim 10 including restraining means for mechanically deforming said convolutions into said generally U-shape to maintain said shape therein.

16. The system of claim 11 including a rigid annular ring disposed axially between said diaphragms and generally radially intermediate said annular convolutions, said ring being connected to the inner face of each said diaphragm.

17. The system of claim 16 wherein said annular ring has two axially disposed annular parts, each connected to the adjacent diaphragm with the two being connected together into an integral unit.

* * * * *